US007905714B2

(12) United States Patent
Gerling

(10) Patent No.: US 7,905,714 B2
(45) Date of Patent: Mar. 15, 2011

(54) PROGRESSING CAVITY PUMP ASSEMBLY AND METHOD OF OPERATION

(75) Inventor: Jordan William Gerling, Lloydminster (CA)

(73) Assignee: Kudu Industries, Inc., Calgary, Alberta (CA)

( * ) Notice: Subject to any disclaimer, the term of this patent is extended or adjusted under 35 U.S.C. 154(b) by 475 days.

(21) Appl. No.: 12/076,642

(22) Filed: Mar. 20, 2008

(65) Prior Publication Data

US 2009/0136371 A1 May 28, 2009

(30) Foreign Application Priority Data

Nov. 27, 2007 (CA) ..... 2612326

(51) Int. Cl.
*F01C 1/10* (2006.01)
*F01C 5/00* (2006.01)
*F03C 2/00* (2006.01)

(52) U.S. Cl. ..... 418/48; 418/1; 418/182; 166/105; 166/68; 417/360

(58) Field of Classification Search ..... 418/1, 48, 418/182; 166/105, 68; 417/360
See application file for complete search history.

(56) References Cited

U.S. PATENT DOCUMENTS

| | | | | | |
|---|---|---|---|---|---|
| RE24,079 | E | * | 10/1955 | Mateer | 418/48 |
| 2,749,992 | A | * | 6/1956 | Hill | 418/48 |
| 3,802,803 | A | | 4/1974 | Bogdanov et al. | |
| 4,957,161 | A | * | 9/1990 | Cholet et al. | 166/105 |
| 5,209,294 | A | * | 5/1993 | Weber | 166/105 |
| 5,549,160 | A | * | 8/1996 | Bownes et al. | 418/48 |
| 5,562,433 | A | * | 10/1996 | Cholet et al. | 418/48 |
| 5,871,051 | A | * | 2/1999 | Mann | 417/360 |
| 6,729,391 | B2 | * | 5/2004 | Hill et al. | 417/360 |
| 7,201,222 | B2 | | 4/2007 | Kanady et al. | |

* cited by examiner

*Primary Examiner* — Theresa Trieu
(74) *Attorney, Agent, or Firm* — Diederiks & Whitelaw, PLC

(57) ABSTRACT

A progressing cavity pump assembly includes a collar assembly connecting a housing and a tubing string, with the collar having an inside diameter upset and the rotor having a rotor head axially spaced from a rotor helix, with the rotor head having an outer diameter forming a stop adapted to land on the inside diameter upset. A method of timing a progressing cavity pump assembly includes providing a collar assembly having an inside diameter upset, movably connecting the collar assembly and the housing, providing a rotor having a rotor head axially spaced from a rotor helix, with the rotor head having an outer diameter forming a stop, selectively adjusting the relative position of the collar assembly and the housing to form a pathway substantially corresponding to the rotor helix, landing the stop on the inside diameter upset, and fixing the relative position of the collar assembly and the housing.

23 Claims, 7 Drawing Sheets

ROTOR RUN-IN

TAGGING

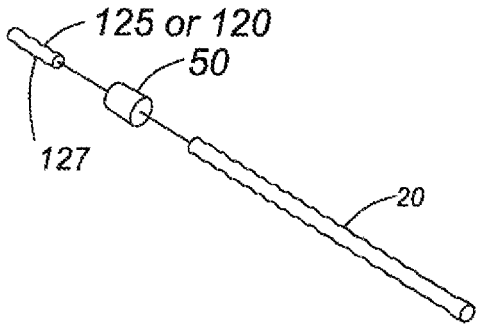
FIG. 5A
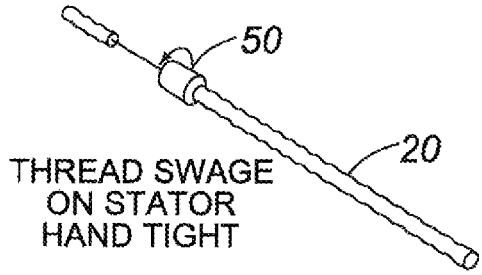
FIG. 5B
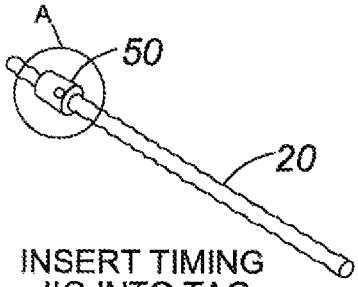
FIG. 5C
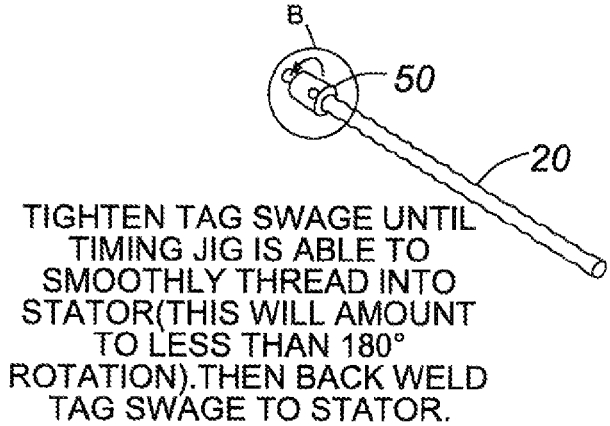
FIG. 5D
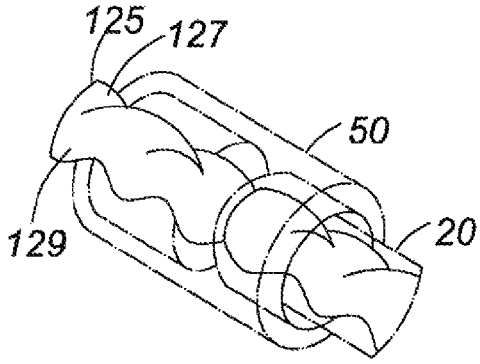
DETAIL A
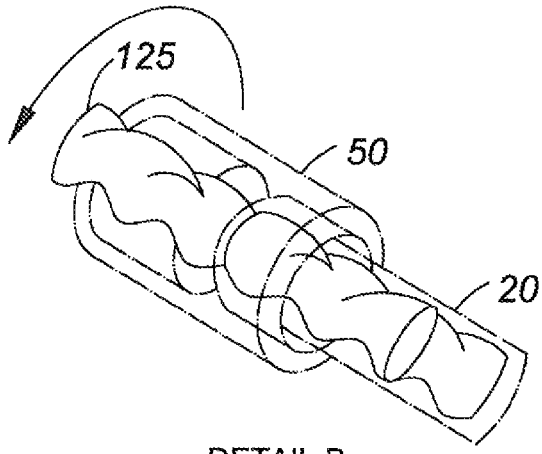
DETAIL B

PROGRESSING CAVITY PUMP ASSEMBLY AND METHOD OF OPERATION

FIELD OF THE INVENTION

The present invention relates generally to progressing cavity pumps driven by a rotating rod driven by a motor at surface or a well bore. More particularly, the present invention relates to an apparatus and method for axially positioning the rotor within the stator.

BACKGROUND OF THE INVENTION

A progressing cavity pump (PCP) is a well known pump, frequently called a "Moineau" pump, that has an elastomeric outer element or stator has a helical inner surface. A metal rotor having a helical exterior inserts within the stator.

Progressing cavity pumps of this type are used for many purposes, particularly, for pumping viscous liquids. These pumps are also used as oil well pumps. When used as an oil well pump, the stator is secured to the lower end of the well tubing and lowered into the casing of the well with the well tubing. The rotor is secured to the lower end of the drive rod and lowered through the tubing to a position inside the stator. The drive rod is rotated by means of a rotary power source at the surface or within the wellbore.

U.S. Pat. No. 7,201,222 (Kanady et al.) teaches a tag shoulder above the helical passage of the stator. The tag shoulder is more restrictive than a passage through the tubing. A pump rotor has a stop located above the rotor. The stop will freely pass through the tubing, but will not pass through the tag shoulder. The rotor is lowered on the rods until the stop lands on the tag shoulder and then the rotor is lifted to accommodate for expected stretch during operation. The stop is dimensioned so that it will orbit without contact with the tag shoulder.

It is, therefore, desirable to provide a progressing cavity pump assembly that provides improved axially positioning the rotor within the stator.

SUMMARY OF THE INVENTION

It is an object of the present invention to obviate or mitigate at least one disadvantage of previous apparatus and method for axially positioning a PCP rotor within the PCP stator.

During the spacing out of a progressing cavity pump, when run-in on the rod string the rotor must be landed in the correct working location within the stator. In order to do this, some method of tagging and confirming the location of the rotor at the surface is needed. Traditionally, this has been through the use of a tagging pin or plate below the stator. The present invention provides a top-tag coupling assembly which includes a rotor head which is larger than the rotor helix, to tag on a narrowing shoulder section of a tubing string collar or coupling above the stator.

The tag-coupling may be aligned radially (timed) with the stator using a jig. Due to the helical shape of each rotor and the double helix opening in each stator a unique path or trajectory is traced by the rotor as it is threaded into the stator. Even small interferes with this path may hinder the run-in of the rotor or the operation of the pump. The present invention provides a narrowing tag shoulder which closely approximates this path allowing smooth run-in and operation. Apart from this, a top-tag coupling is similar to a typical collar normally threaded to the output end of a stator. Once threaded on hand tight, there is still thread enough to time the tag shoulder to end up in close proximity to the entrance of the stator helix, reducing inherent binding. The present invention provides a top-tag coupling to fit a group of pumps and once timed are welded to maintain the proper orientation of top-tag coupling to stator.

The elimination of the pin, plate, or bar below the pump, restrictions on fluid intake are lessened, production may be increased, and it is possible to coil monitoring or other equipment pas the rotor without obstruction. As well, production and assembly are somewhat streamlined.

In a first aspect, the present invention provides a PCP assembly, having a housing with a stator, having a stator bore, the housing adapted to receive a rotor within the stator bore, a collar assembly, having an inside diameter upset, the collar assembly adapted to connect the housing and a tubing string, and the rotor having a rotor head axially spaced from a rotor helix, the rotor head having an outer diameter forming a stop, the stop adapted to land on the inside diameter upset, the rotor head adapted to connect with a drive string.

Preferably, the housing and the collar assembly are axially and/or rotationally movable until the collar assembly and housing are timed. After they are timed, preferably they are welded. Preferably, the connection between the housing and the collar assembly is a slip fit or threaded connection. The housing and the collar assembly may be integral.

Preferably, the collar assembly is a coupling. The coupling may form a swage. The housing may have a greater diameter than the diameter of the tubing string. The diameter of the housing may be less than the diameter of the tubing string. The diameter of the housing and the diameter of the tubing string may be substantially equal.

Preferably, the collar assembly and the housing are proximate. Preferably, the collar assembly and the housing are adjacent.

Preferably, the inside diameter upset comprises a tag shoulder. The tag should may have an axial profile. The profile may be straight or planar. Preferably, the profile includes a taper, a chamfer, or a fillet.

Preferably, the inside diameter upset comprising a coupling tag bore, the coupling tag bore adapted to allow the threading of the rotor through the coupling tag bore. Preferably, the coupling tag bore timed to the stator bore to allow insertion of the rotor.

Preferably, the coupling tag bore and the stator bore forming a pathway, the pathway adapted to movably receive the rotor. Preferably, the pathway is adapted to receive the rotor in a rotating threading motion.

In a further aspect, the present invention provides a method of operating a PCP assembly, comprising providing a tubing string, providing a housing comprising a stator, a collar assembly, timed to the stator, connected with the housing, the collar assembly having an inside diameter upset, connecting the tubing string and the housing, installing the tubing string and the housing into a wellbore, providing a drive string, providing a rotor having a rotor head axially spaced from a rotor helix, the rotor head having an outer diameter forming a stop, connecting the rotor and the drive string, installing the rotor and the drive string into the wellbore by rotatably threading the rotor into the stator through the collar assembly until the stop lands on the inside diameter upset, and lifting the rotor a selected distance by lifting the drive string from surface.

Preferably, the method includes rotating the drive string, thereby rotating the rotor within the stator to pump fluids from the wellbore up the tubing string.

In a further aspect, the invention provides a method of timing a progressing cavity pump assembly by providing a housing comprising a stator, having a stator bore, providing a collar assembly, the collar assembly having an inside diameter upset, movably connecting the collar assembly and the housing, providing a timing piece, the timing piece having a timing helix adapted to fit the stator bore, selectively adjusting the relative position of the collar assembly and/or the housing to form a pathway substantially corresponding to the timing helix, providing a rotor having a rotor head axially spaced from a rotor helix, the rotor head having an outer diameter forming a stop, and installing the rotor into the housing by threading the rotor into the stator through the collar assembly until the stop lands on the inside diameter upset, and fixing the relative position of the collar assembly and/or the housing.

Preferably, the timing piece is a timing jig or the rotor.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIGS. 5*a-d* are perspective views of a PCP assembly in accordance with the present invention, showing the timing of the collar and stator.

DETAILED DESCRIPTION

Figure 1A:
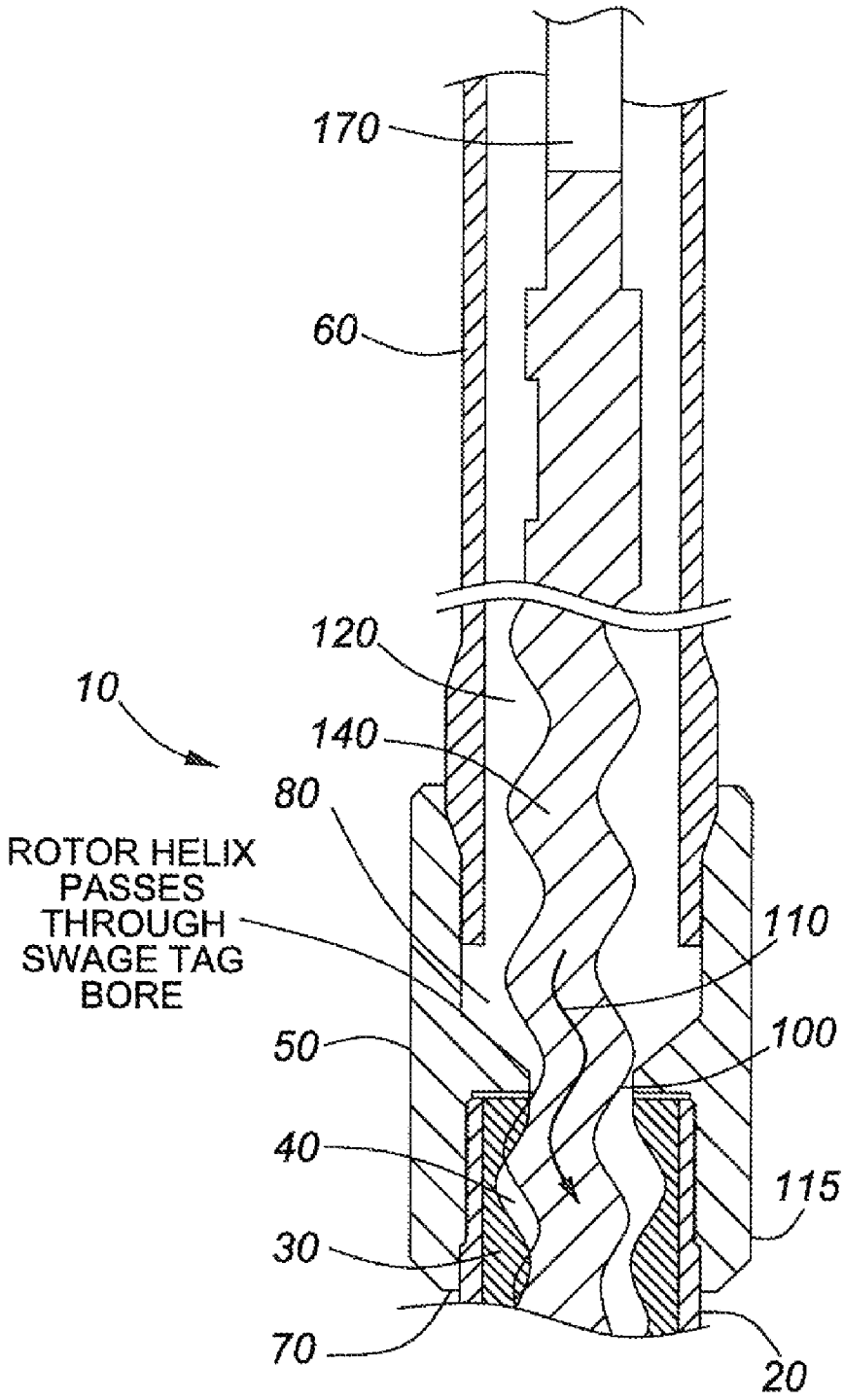
FIG. 1*a* is a vertical cross-section view of a PCP assembly in accordance with the present invention, showing the rotor being threaded into the stator.
Figure 1B:
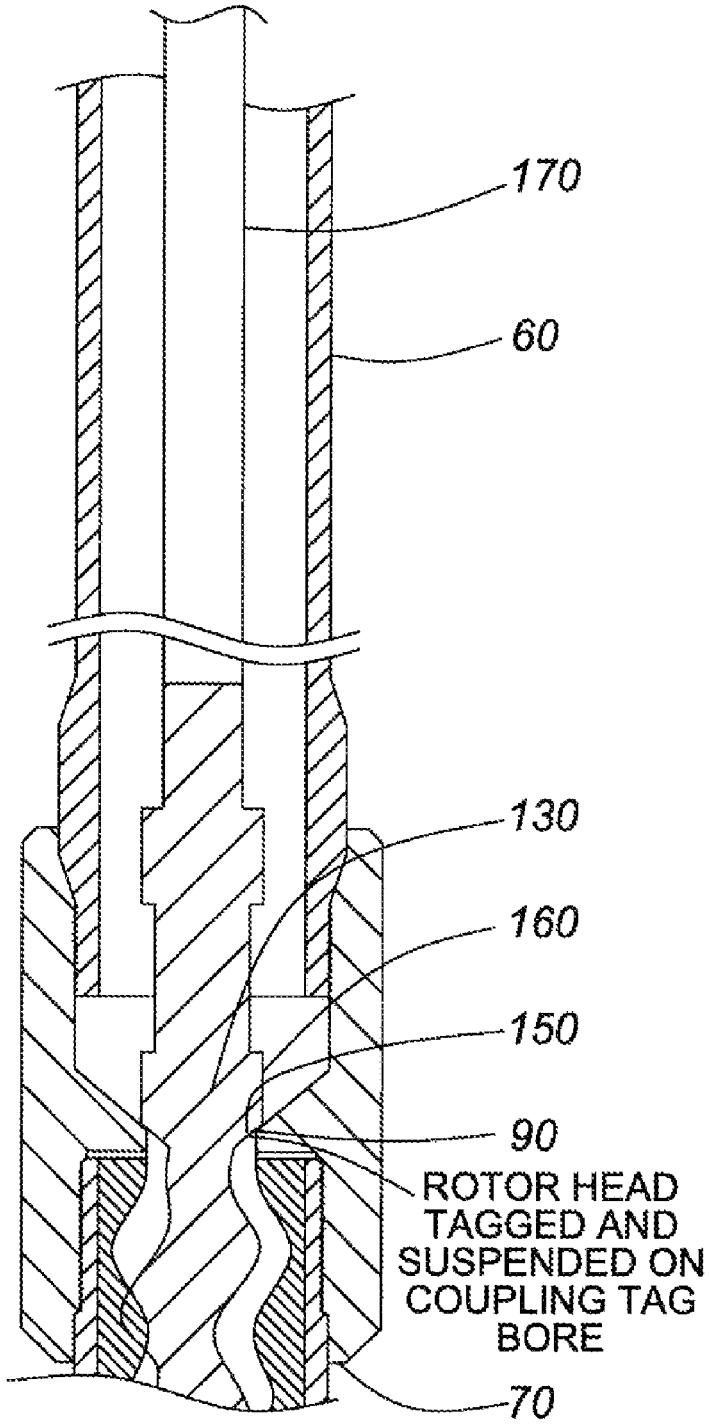
FIG. 1*b* is a vertical cross-section view of the PCP assembly of FIG. 1*a*, showing the stop landed on the inner diameter upset.
Figure 2A:
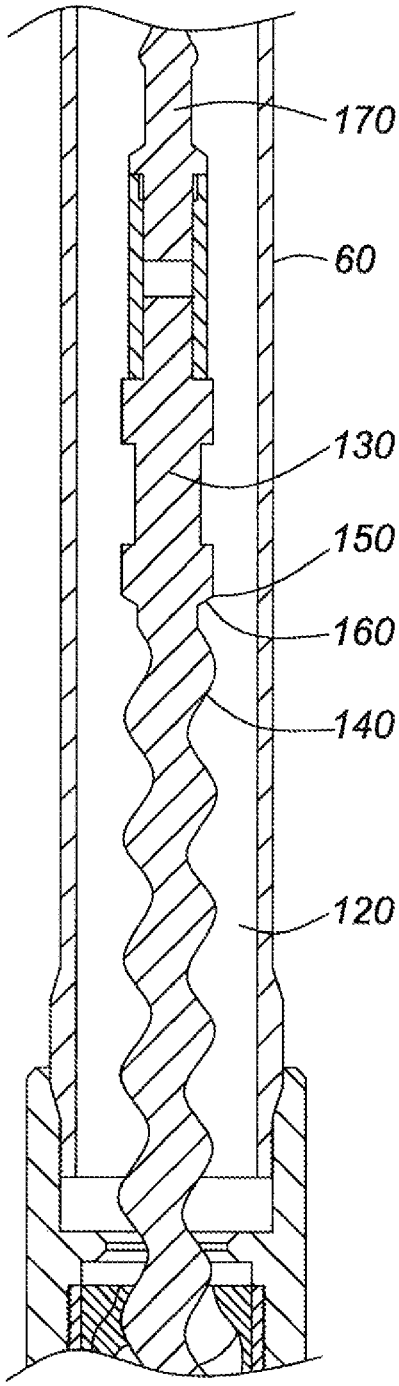
FIG. 2*a* is a vertical cross-section view of a PCP assembly in accordance with the present invention, showing the rotor being threaded into the stator.
Figure 2B:
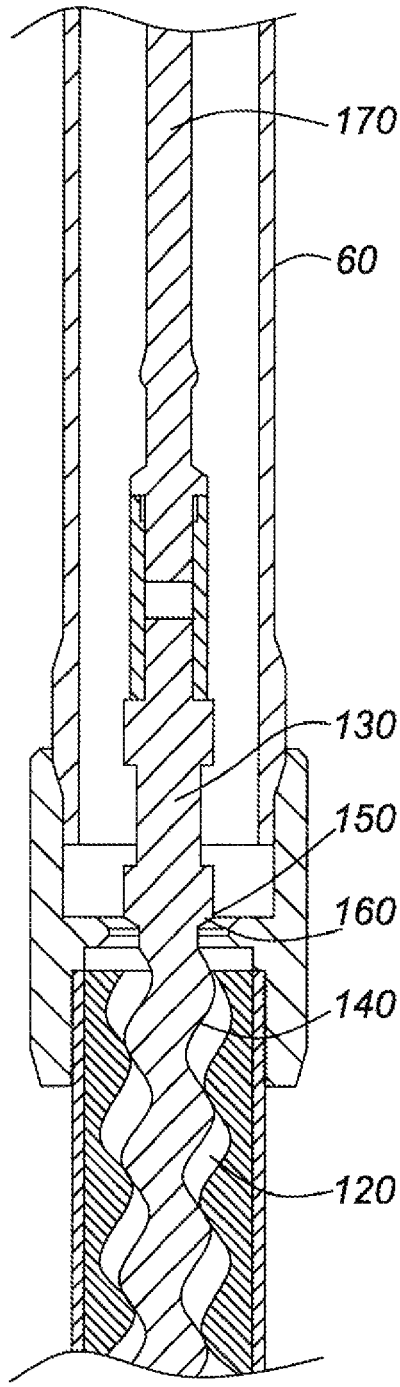
FIG. 2*b* is a vertical cross-section view of the PCP assembly of FIG. 2*a*, showing the stop landed on the inner diameter upset.

Generally, the present invention provides a method and apparatus for providing a top tag system for a progressing cavity pump (PCP).

Referring to FIGS. 1*a-b* and 2*a-b*, a PCP assembly 10 of the present invention provides a housing 20 having a stator 30, the stator 30 having a stator bore 40.

A collar assembly 50 joins the housing 20 and a tubing string 60. The joint may be threaded or slip on. A weld 70 or other bond (such as adhesive) fixes the joint in place. The weld 70 may be a tack weld or seal welded. Alternatively, the collar assembly 50 may be integral with the housing 20. The collar assembly 50 has an inner diameter upset 80 in the form of a tag shoulder 90 having a coupling tag bore 100. The collar assembly 50 is timed to the stator bore 40 such that a pathway 110 is formed by the coupling tag bore 100 and the stator bore 40.

In the preferred embodiment shown, the collar assembly 50 forms a swage 115, the tubing string 60 having a greater diameter than that of the housing 20.

A rotor 120, having a rotor head 130 axially spaced from a rotor helix 140 is received in the stator bore 40 through the pathway 110. The rotor head 130 incorporates an outer diameter 150 forming a stop 160. The rotor 120 is rotatably threaded into the stator bore 40 through the pathway 110 on a drive string 170.

The stop 160 of the rotor 120 lands on the inner diameter upset 80 in the form of a tag shoulder 90.

Figure 3A:
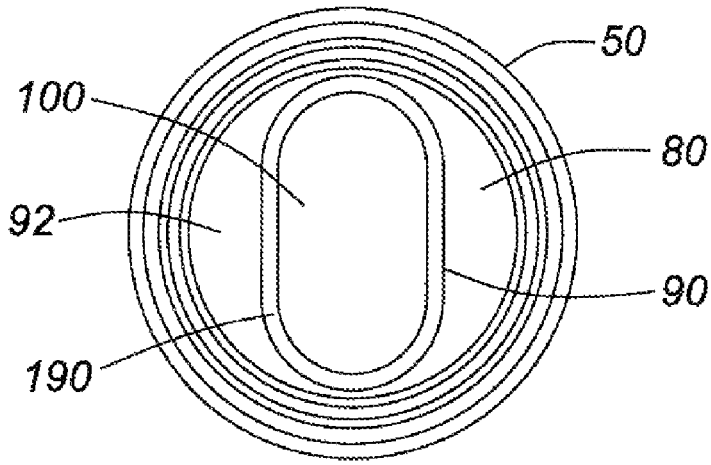
FIG. 3*a* is a detail top view of a collar of the present invention, showing a collar adapted for a housing and a tubing string of approximately the same diameter.
Figure 3B:
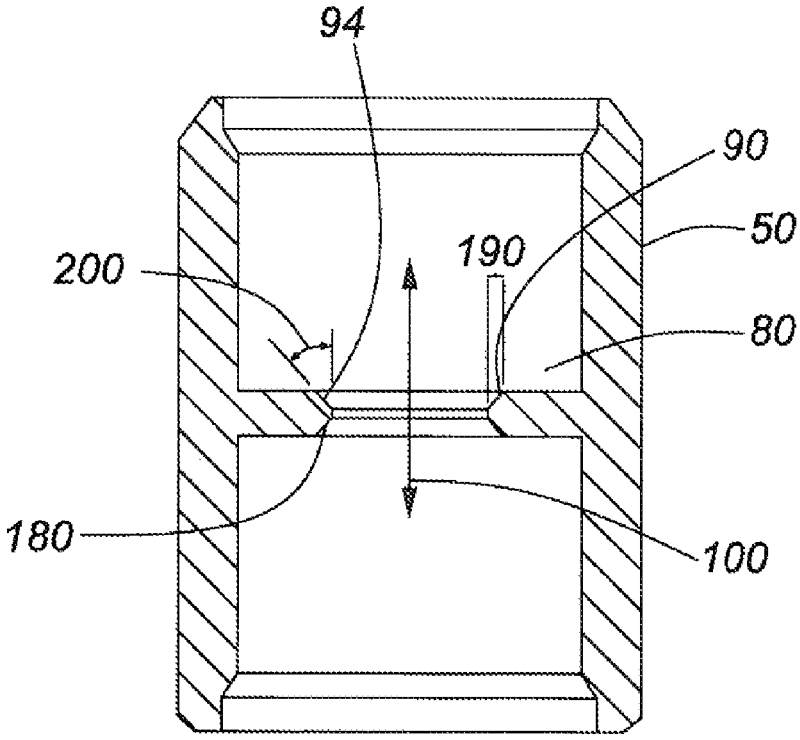
FIG. 3*b* is a detail vertical cross-section view of the collar of FIG. 3*a;*

Referring to FIGS. 3*a-b*, the collar assembly 50 provides an inner diameter upset 80 in the form of a tag shoulder 90, having a coupling tag bore 100. The coupling tag bore 100 is substantially timed to the stator bore 40 to allow the insertion of the rotor 120 with reduced interference. The tag shoulder 90 has an axial profile 180 to land the stop 160 of the rotor 120. The axial profile has a taper 190 at an angle 200. The angle 200 preferably is within a range of about 0 to 90 degrees. Preferably, the angle 200 is between about 15 degrees and about 75 degrees. Preferably, the angle 200 is about 45 degrees. Preferably, the tag shoulder 90 includes a conical ledge 92. Preferably, tag shoulder 90 has a beveled edge 94.

Figure 4:
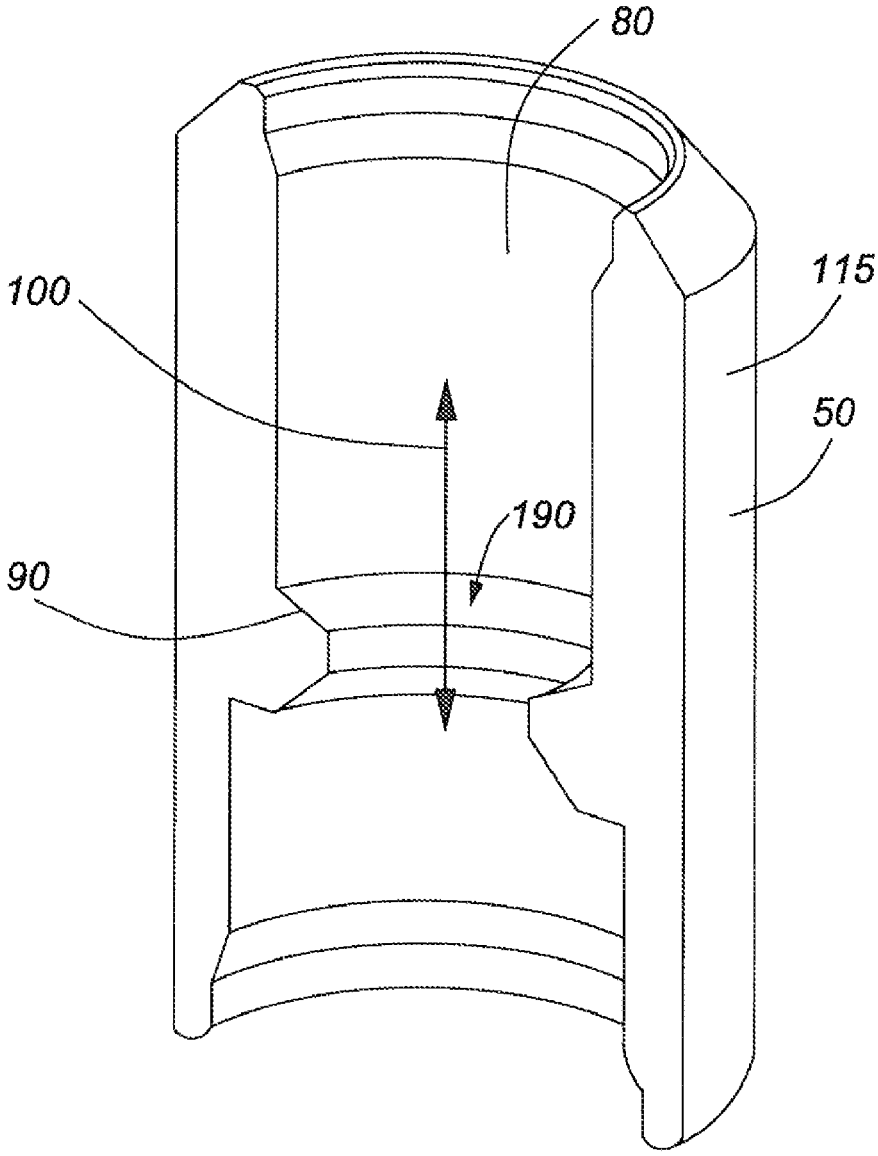
FIG. 4 is a perspective cross-section view of a collar assembly of the present invention, showing a coupling adapted for a housing diameter greater than the tubing string diameter.
Figure 6:
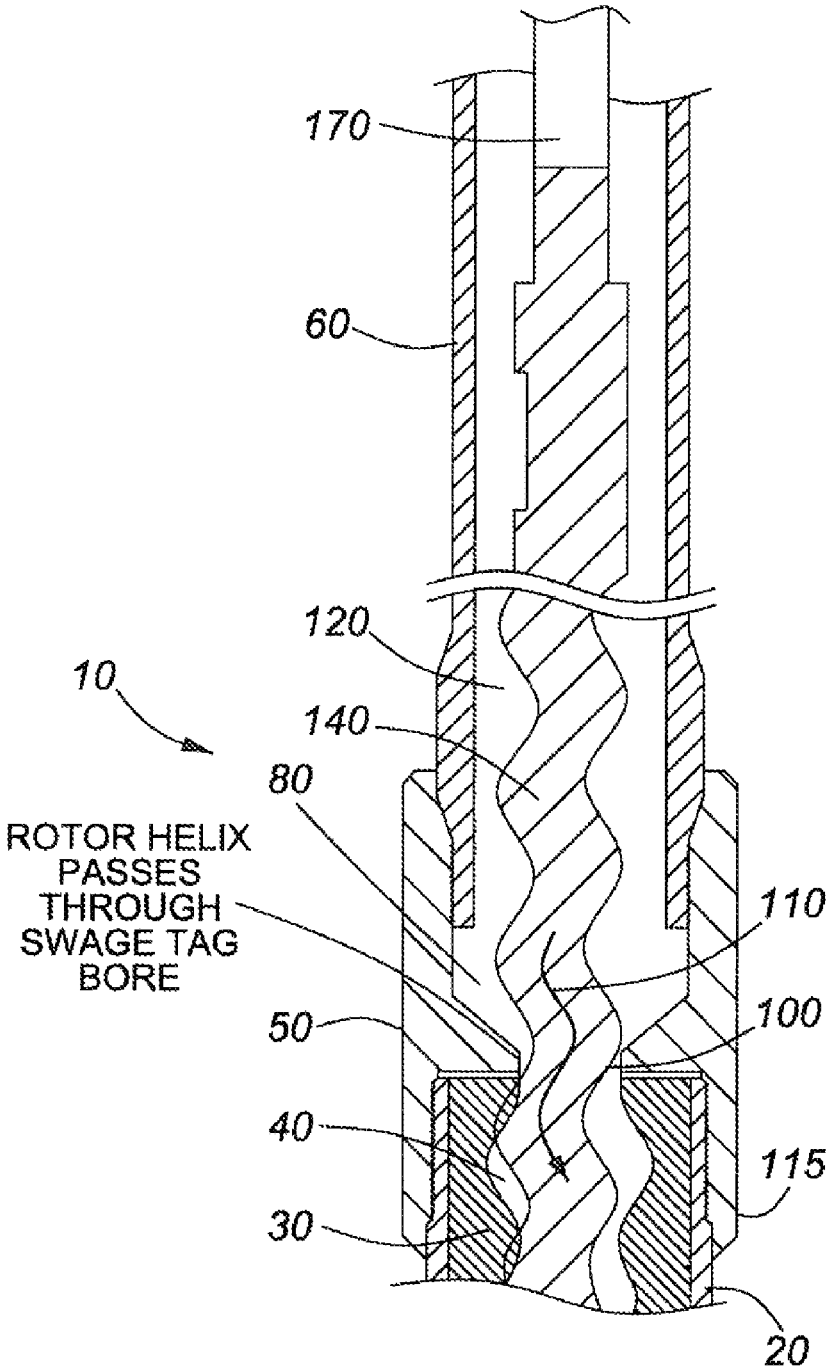
FIG. 6 is a vertical cross-section of a PCP assembly in accordance with the present invention, showing a housing having a diameter greater than the tubing string.

Referring to FIG. 4, the collar assembly 50 in the form of the coupling 115 provides an inner diameter upset 80 in the form of a tag shoulder 90, having a coupling tag bore 100. The swage 115 is adapted to receive the tubing string 60 (see FIGS. 1*a*-1*b*) having a diameter greater than that of the housing 20 (see FIGS. 1*a*-1*b*), in this case, the coupling 115 being a swage.

The tag shoulder 90 has an axial profile 180 to land the stop 160 of the rotor 120. The axial profile has a taper 190 at an angle 200. The angle 200 preferably is within a range of about 0 to 90 degrees. Preferably, the angle 200 is between about 15 degrees and about 75 degrees. Preferably, the angle 200 is about 45 degrees.

Referring to FIGS. 5*a-d*, the housing 20 has the stator 30 having the stator bore 40. The corresponding collar assembly 50 is attached to the housing 20 by a threaded or slip on connection. The axial and rotational position of the collar assembly 50 is selectively adjusted to approximate the pathway 110 through the coupling tag bore 100 and the stator bore 40 for the rotor 120.

The rotor 120 or a timing jig 125, referred to generally as a timing piece 127 having a timing helix 129 adapted to fit the stator bore 40 is threadably (axially and rotatably) inserted through the coupling tag bore 100 and the stator bore 40. In the case of the rotor 120, it may be inserted until the stop 160 lands on the tag shoulder 90. The position of the collar assembly 50 is selectively adjusted relative to the housing 20 to reduce or minimize the interference between the timing piece 127 (whether it is the rotor 120 or the timing jig 125) 140 and the pathway 110 to allow the smooth insertion and/or removal of the rotor 120. The collar assembly 50 may then be fixed to the housing 20 by a weld 70. A timing jig 125 or a 'core', known to one skilled in the art, is in the form of a double stator (as shown). Preferably, the timing jig 125 is used to tag the rotor 120 as described.

In the preceding description, for purposes of explanation, numerous details are set forth in order to provide a thorough understanding of the embodiments of the invention. However, it will be apparent to one skilled in the art that these specific details are not required in order to practice the invention.

As used herein tubing string may include conventional jointed tubing or endless or coiled tubing or a combination thereof.

As used herein drive string may include conventional jointed sucker rod, continuous sucker rod, jointed drive rod, continuous drive rod or a combination thereof.

The present invention has been described generally in terms of a one (1) lobe rotor, two (2) lobe stator for simplicity. One skilled in the art recognizes that the present invention is applicable to PCP pumps generally, which includes two (2) lobe rotor/three (3) lobe stator, three (3) lobe rotor/four (4) lobe stator, four (4) lobe rotor/five (5) lobe stator, seven (7) lobe rotor/eight (8) lobe stator, or generally n lobe rotor/n+1 lobe stator. The corresponding timing jig 125 having n+1 lobes. As shown in FIG. 5, the timing jig 125 has two lobes.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A progressing cavity pump assembly, comprising:

a housing comprising a stator, having a stator bore, the housing adapted to receive a rotor within the stator bore;

a collar assembly, having an inside diameter upset, the collar assembly adapted to connect the housing and a tubing string; and the rotor having a rotor head axially spaced from a rotor helix, the rotor head having an outer diameter forming a stop, the stop adapted to land on the inside diameter upset, the rotor head adapted to connect with a drive string.

2. The progressing cavity pump assembly of claim 1, wherein the housing and the collar assembly are relatively axially movable.

3. The progressing cavity pump assembly of claim 1, wherein the housing and the collar assembly are relatively rotationally movable.

4. The progressing cavity pump assembly of claim 1, wherein the housing and the collar assembly are welded.

5. The progressing cavity pump assembly of claim 1, wherein the housing and the collar assembly are threaded.

6. The progressing cavity pump assembly of claim 1, wherein the housing and the collar assembly are integral.

7. The progressing cavity pump assembly of claim 1, the collar assembly comprising a coupling.

8. The progressing cavity pump assembly of claim 7, wherein the diameter of the housing is greater than the diameter of the tubing string.

9. The progressing cavity pump assembly of claim 7, wherein the diameter of the housing is less than the diameter of the tubing string.

10. The progressing cavity pump assembly of claim 1, wherein the collar assembly and the housing are proximate.

11. The progressing cavity pump assembly of claim 1, wherein the collar assembly and the housing are adjacent.

12. The progressing cavity pump assembly of claim 1, the inside diameter upset comprising a tag shoulder.

13. The progressing cavity pump of claim 12, the tag shoulder having an axial profile.

14. The progressing cavity pump of claim 13, the axial profile comprising a taper.

15. The progressing cavity pump assembly of claim 1, the inside diameter upset forming a coupling tag bore, the coupling tag bore adapted to allow the threading of the rotor through the coupling tag bore.

16. The progressing cavity pump assembly of claim 15, the coupling tag bore timed to the stator bore to allow insertion of the rotor.

17. The progressing cavity pump assembly of claim 16, the coupling tag bore and the stator bore forming a pathway, the pathway adapted to movably receive the rotor.

18. The progressing cavity pump assembly of claim 17, wherein the pathway is adapted to receive the rotor in a rotating threading motion.

19. A method of operating a progressing cavity pump assembly, comprising:

providing a tubing string;

providing a housing comprising a stator, a collar assembly, timed to the stator, connected with the housing, the collar assembly having an inside diameter upset;

connecting the tubing string and the housing;

installing the tubing string and the housing into a wellbore;

providing a drive string;

providing a rotor having a rotor head axially spaced from a rotor helix, the rotor head having an outer diameter forming a stop;

connecting the rotor and the drive string;

installing the rotor and the drive string into the wellbore by rotatably threading the rotor into the stator through the collar assembly until the stop lands on the inside diameter upset; and lifting the rotor a selected distance by lifting the drive string from surface.

20. The method of claim 19, further comprising:

rotating the drive string, thereby rotating the rotor within the stator to pump fluids from the wellbore up the tubing string.

21. A method of timing a progressing cavity pump assembly comprising:

providing a housing comprising a stator, having a stator bore;

providing a collar assembly, the collar assembly having an inside diameter upset;

movably connecting the collar assembly and the housing;

providing a timing piece, the timing piece having a timing helix adapted to fit the stator bore;

selectively adjusting the relative position of the collar assembly and the housing to form a pathway substantially corresponding to the timing helix;

providing a rotor having a rotor head axially spaced from a rotor helix, the rotor head having an outer diameter forming a stop, and installing the rotor into the housing by threading the rotor into the stator through the collar assembly until the stop lands on the inside diameter upset; and fixing the relative position of the collar assembly and the housing.

22. The method of claim 21, wherein the timing piece comprises a timing jig.

23. The method of claim 21, wherein the timing piece comprises the rotor.

* * * * *